United States Patent [19]

Smit et al.

[11] 4,440,637

[45] Apr. 3, 1984

[54] ROTARY GRAIN SCREENERS

[75] Inventors: Edward H. Smit, Sheffield; Eugene G. Sukup, Dougherty, both of Iowa

[73] Assignee: Sukup Manufacturing Co., Sheffield, Iowa

[21] Appl. No.: 373,699

[22] Filed: Apr. 30, 1982

[51] Int. Cl.[3] ..... B07B 1/24

[52] U.S. Cl. ..... 209/241; 209/257; 209/291; 209/369; 209/421; 210/326

[58] Field of Search ..... 209/241, 257, 289-291, 209/369, 421; 210/326; 74/665 GA, 665 GE, 665 K

[56] References Cited

U.S. PATENT DOCUMENTS

| | | | |
|---|---|---|---|
| 419,696 | 1/1890 | Merrell | 209/291 |
| 433,096 | 7/1890 | Sadravezt | 209/291 |
| 1,088,117 | 2/1914 | Walter | 209/291 |
| 1,181,360 | 5/1916 | Walsh | 209/257 |
| 3,469,708 | 9/1969 | Pennington | 74/665 K |
| 4,312,750 | 1/1982 | Braun et al. | 209/291 |

*Primary Examiner*—David L. Lacey

*Attorney, Agent, or Firm*—Neuman, Williams, Anderson & Olson

[57] ABSTRACT

A rotary grain screener is disclosed in which a reverse drive transmission assembly is provided at one end of the screener and in which a second drive transmission assembly is provided at the opposite end of the screener for driving an outer drum, an inner drum being secured to a central shaft which is driven from the outer drum through the reverse drive transmission assembly. The second drive transmission assembly also drives an auger in a pan which underlies the screens and a conveyor for conveying foreign materials upwardly out of the pan.

14 Claims, 10 Drawing Figures

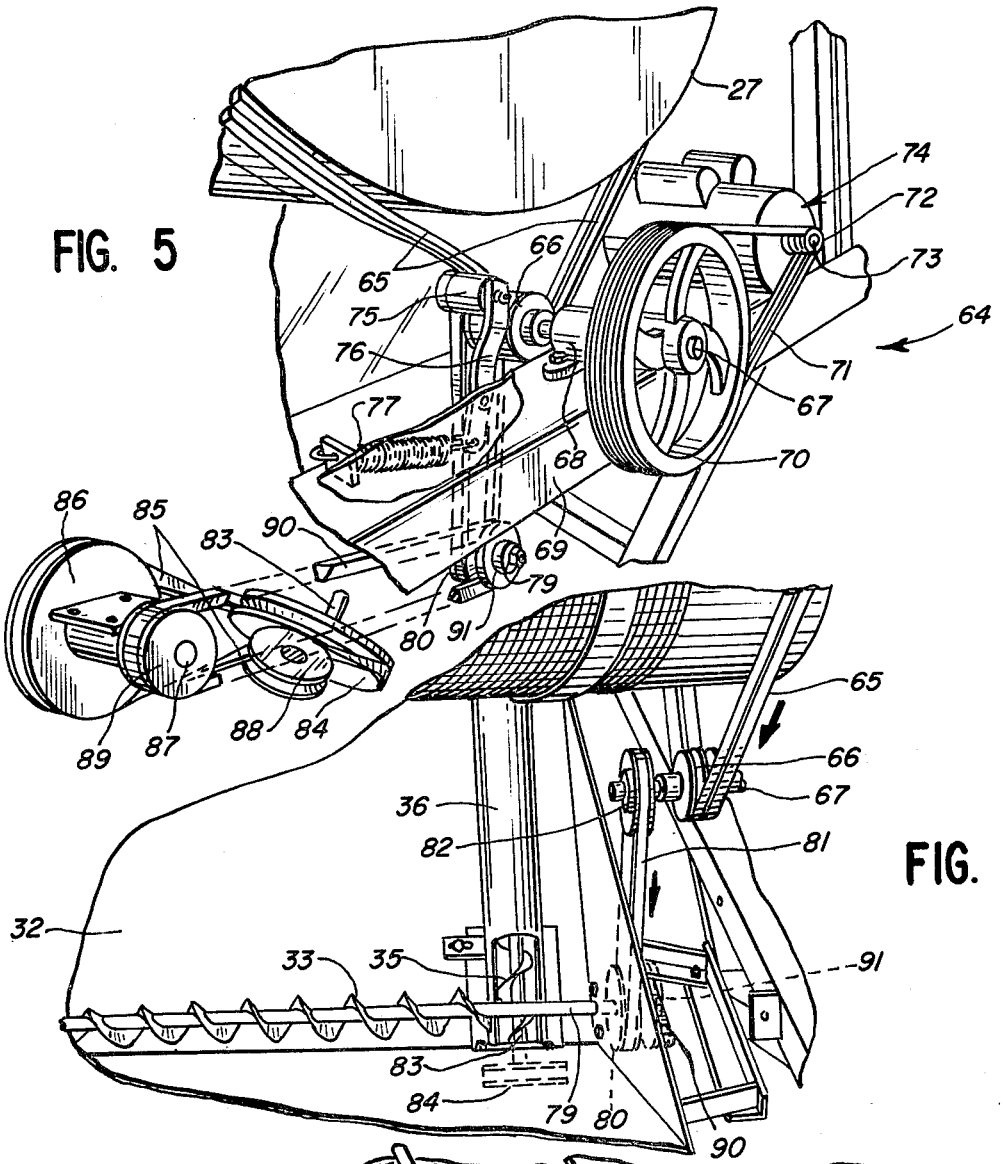
FIG. 5
FIG. 6
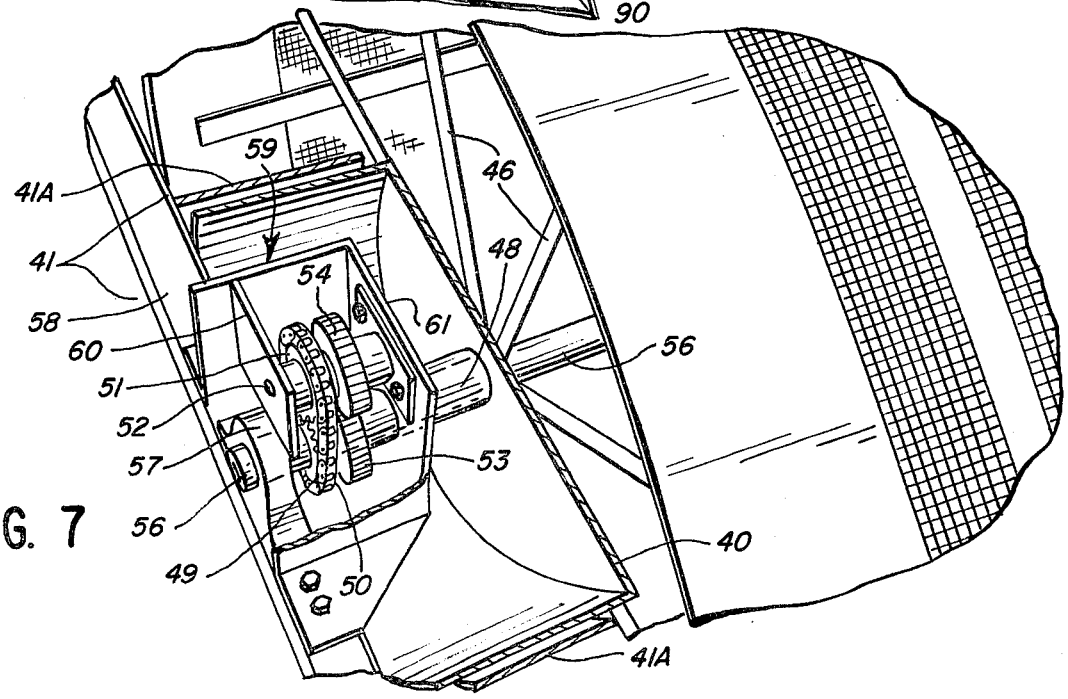
FIG. 7

FIG. 8
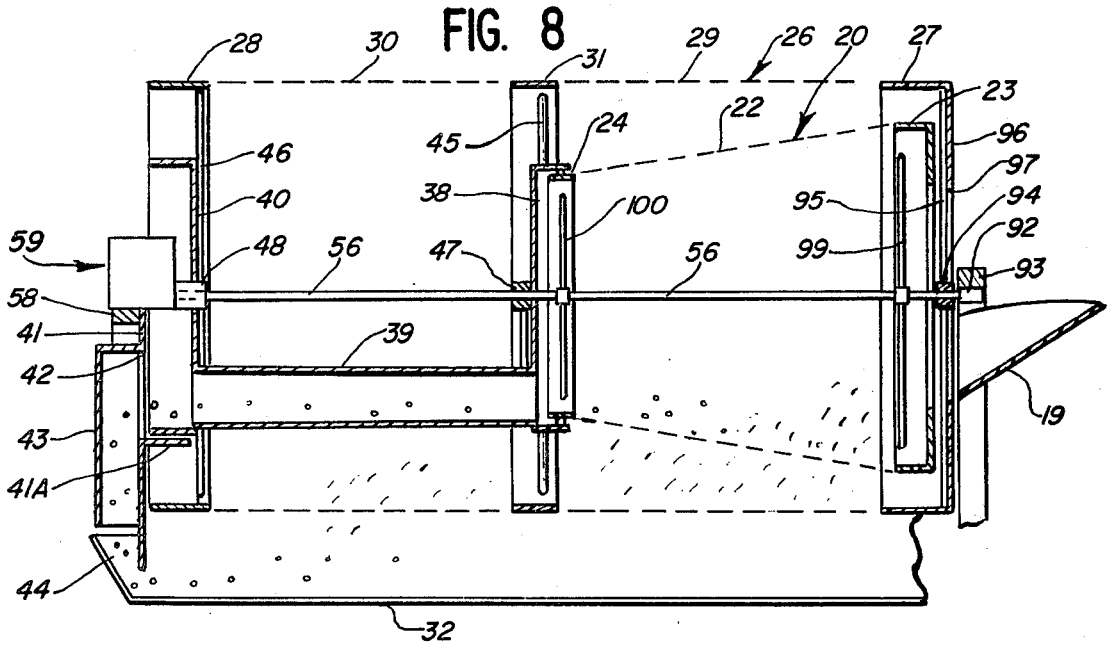
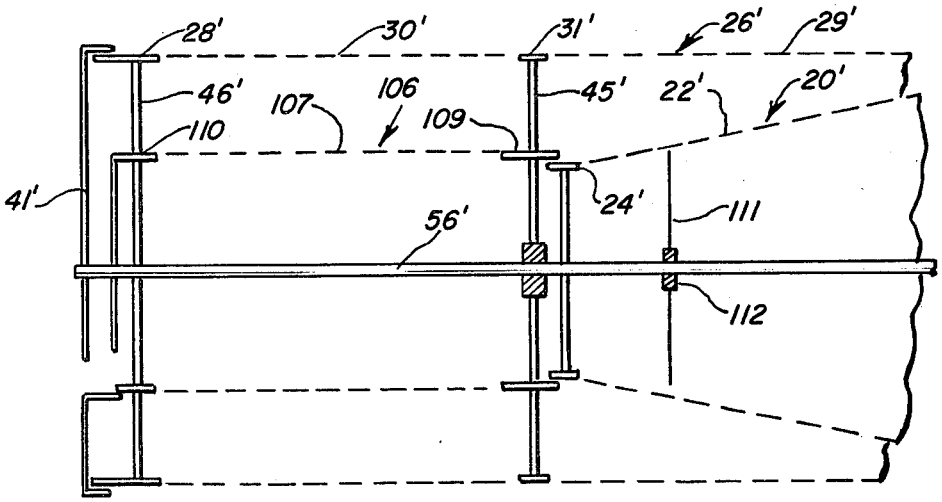
FIG. 9
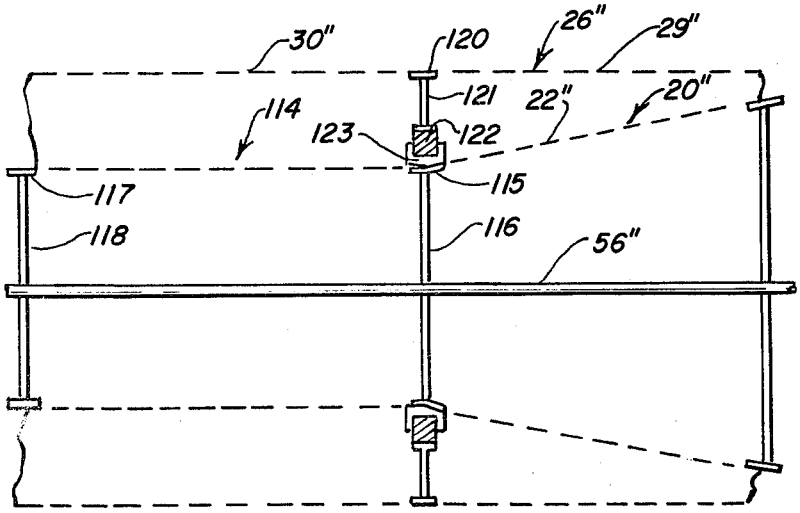
FIG. 10

ROTARY GRAIN SCREENERS

This invention relates to rotary grain screeners and more particularly to screeners which remove both coarse and fine foreign materials from grains. The screeners of the invention are easy to use and are very efficient while being rugged and highly reliable. They are compact and relatively simple, using a minimum number of component parts which may be readily assembled, the screeners being thereby economically manufacturable while also being easy to clean and service.

BACKGROUND OF THE INVENTION

Screeners for cleaning grain and the like have heretofore been provided which include one or more rotary screens to separate the grain from foreign materials. In one type of screener, inner and outer coaxial drums are provided, each including an annular screen supported by a plurality of axially spaced rims. The grain to be cleaned is supplied into the inner drum to fall through the screen thereof which may have a relatively coarse mesh, coarse foreign materials being retained within the inner drum. The outer drum has a fine mesh screen to allow fine foreign materials to pass therethrough, the grain being collected in the fine mesh screen of the outer drum for removal from one end thereof.

In one type of construction, the coarse foreign materials are removed from one end of the inner drum by passing radially outwardly through a chute which is secured to the inside of the screen of the outer drum at a position intermediate the ends thereof. The coarse materials thus are discharged downwardly and may be received in a pan which also receives the fine foreign materials passing through the outer drum. The pan may be provided with an opening in its bottom and suitable auger means for moving the foreign materials to the opening. Drive means are provided for rotating the drums in opposite directions and in one type of construction, a pulley is connected through a shaft to the inner drum and is driven through a belt from a shaft which extends longitudinally alongside the drums, the shaft being driven by a motor and being also arranged to drive another belt to drive a pulley which is connected to the outer drum at the opposite end.

SUMMARY OF THE INVENTION

This invention was evolved with the general object of improving upon prior rotary grain screeners, increasing the efficiency thereof while also providing screeners which are easy to use and which at the same time are inexpensive to manufacture, rugged and reliable.

An important aspect of the invention is in the recognition of the causes of problems with prior art constructions. More particularly, it is recognized that one of the problems has to do with the drive of the drums in opposite directions which has heretofore not only required a complicated construction with plural drive belts but has also been such as to make the screener difficult to manufacture and assemble.

In a grain screener constructed in accordance with the invention, a reverse drive transmission assembly is provided which is preferably of a quite compact form and which includes first and second members journalled for rotation on the common axis of rotation of the two drums, such first and second members being rotated in opposite directions. The first member is coupled to the inner drum through spokes or the like which extend radially outwardly to a rim of the inner drum and the second member is similarly connected to a rim of the outer drum.

Preferably, the inner drum is connected to a shaft which extends through a bushing to the first drive transmission member, the bushing being connected to the second drive transmission member and which is connected to the outer drum. A second drive transmission is provided for driving one of the drums from a motive power source such as an electric motor, the other drum being rotated in a reverse direction through the reverse drive transmission assembly.

With this comparatively simple arrangement, the screener can be readily manufactured and assembled, using a minimum number of parts and at the same time, it is rugged and highly reliable in operation.

In a preferred construction of the reverse drive transmission, one of the aforementioned first and second members thereof carries a gear which is meshed with a gear on a counter shaft, the counter shaft being coupled to the other member through a chain and two sprockets. Thus, a positive drive connection is obtained with a compact assembly which may preferably be enclosed in a protective housing and which may be lubricated as required to provide highly reliable service, with minimum maintenance.

Another important advantage is that the drive occupies little space and as a result, the design, construction, operation and servicing of other components of the screener is facilitated.

The reverse drive transmission is preferably provided at an end of the outer drum which is opposite the end of the drum at which a drum-drive transmission assembly is provided for drive from the motor or other power source. Preferably, the drum-drive transmission assembly drives the outer drum and most preferably, it includes a belt which is entrained about the outside of a rim portion of the outer drum. This arrangement is advantageous in that no separate pulley is required and in addition, the arrangement facilitates the construction and assembly of the components which are located adjacent to the one end of the outer drum.

Another advantage of the drum-drive arrangement is that a shaft which carries a pulley for the drum-drive belt may be located on the underside of the drum on an axis which is relatively close to the axis of an auger in a collection pan below the drum, requiring only a relatively short drive belt connection to the auger.

Another feature of the screener is in the provision of a built-in conveyor for transporting foreign materials from the collection pan to an elevated point from which they may be discharged, as desired. The materials need not be discharged from the underside of the pan and as a result, the pan can be located relatively close to the ground and the vertical height of the screener can be reduced. Preferably, the discharge conveyor is located at one end of the pan, close to the end at which the drum-drive is provided, and the vertical conveyor is driven through a belt from the auger shaft.

The drum-drive arrangement of the invention is usable advantageously in screeners which have various arrangements for discharge of coarse foreign materials from the inner drum. In one type of screener, the inner screen is preferably of frusto-conical shape and it has a forward large diameter end for receiving grain to be cleaned. Coarse foreign materials are moved axially rearwardly and are moved from the small diameter end of the inner drum into a manifold positioned adjacent the rearward end of the outer drum. In one arrangement, the inner drum is shorter than the outer drum and the coarse foreign materials are moved axially from the small diameter end of the inner drum to the manifold through an axially extending conduit which may preferably be supported from a central shaft of the screens at a distance from the axis of rotation of the drums and which is rotated in a manner such as to receive materials from the inner drum and discharge them into the manifold.

In another arrangement, the coarse materials are supplied to the manifold through an outlet screen which is effectively part of the inner drum and which may either be formed separately therefrom or as an integral extension thereof. The outlet screen in either case serves to clean as well as convey, retaining coarse materials while allowing grain to fall therethrough. When formed separately, a suitable bearing support for an intermediate rim of the outer drum may be provided between the end of the inner drum and the outlet screen. In the arrangement in which the outlet screen is formed as an integral extension of the inner drum screen, a bearing support for an intermediate rim of the outer drum may be provided from the outside, at the junction between the outlet and inner drum screens.

Such arrangements have an important advantage in that the coarse foreign materials are conveyed axially to the manifold at an end of the screener opposite the end at which the grain to be cleaned is supplied to obtain improved cleaning action. No chute or other removing structure is secured to the inside of the outer screen.

Another advantage of such arrangements is that the coarse foreign materials may be separately collected, if desired, or the coarse foreign materials may selectively be delivered back down into the lower collection pan to be mixed with the fine foreign materials.

This invention contemplates other objects, features and advantages which will become more fully apparent from the following detailed description taken in conjunction with the accompanying drawings.

BRIEF DESCRIPTION OF THE DRAWINGS

FIG. 5 is a perspective view showing a drive motor and a drive transmission for driving an outer drum and an auger therefrom;

FIG. 6 is another perspective view showing portions of the drum-drive transmission shown in FIG. 5 and showing the drive of certain augers therefrom;

FIG. 7 is a perspective view showing a reverse drive transmission assembly of the invention;

FIG. 8 is a sectional view in schematic form, particularly illustrating the feed of coarse foreign materials from an inner drum of the screener of FIGS. 1–7;

FIG. 9 is a schematic view similar to a portion of FIG. 8, illustrating a modified arrangement for feed of coarse foreign materials; and FIG. 10 is a view similar to FIG. 9, showing another modified arrangement for feed of coarse foreign materials.

DESCRIPTION OF PREFERRED EMBODIMENTS

Figure 1:
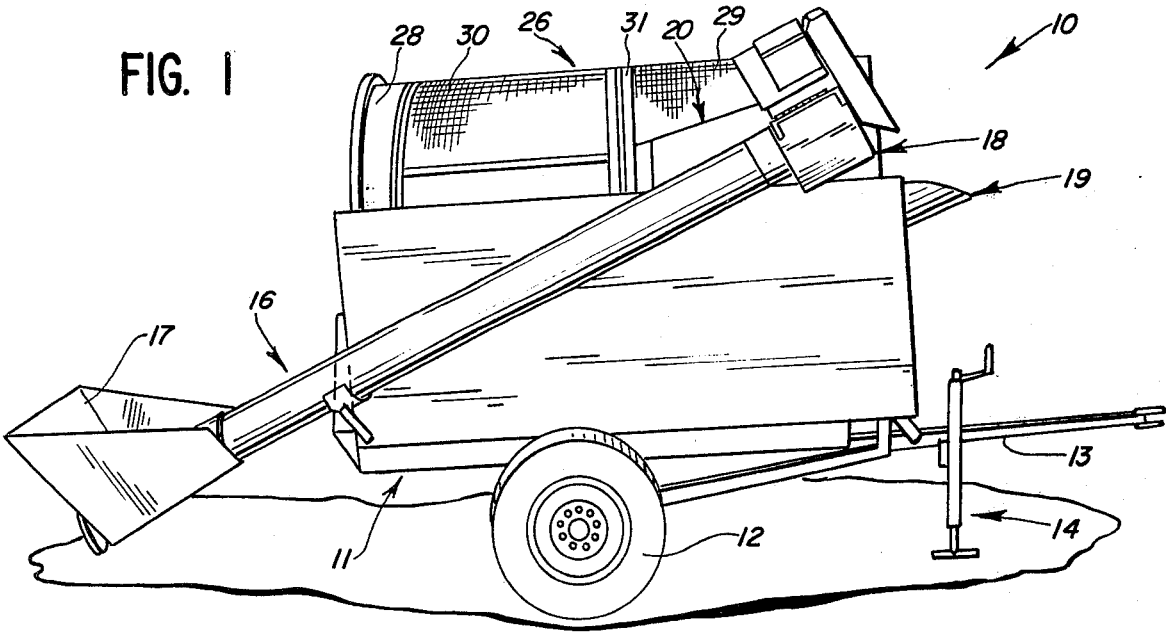
FIG. 1 is a perspective view of a rotary screener constructed in accordance with the principles of the invention, a feed-in conveyor unit being shown on one side of the screener in a position in which it may be disposed during transport.

Reference numeral 10 generally designates a screener constructed in accordance with the principles of the invention. The screener 10 is designed for cleaning grain such as shelled corn, soybeans, wheat, oats and the like and it includes a frame structure generally designated by reference numeral 11 which is supported on a pair of wheels 12, a tongue 13 being provided for connection to a tractor or other vehicle to pull the screener to a desired operating location and a jack 14 being provided for support of the tongue 13. A feed-in conveyor 16 is supported during transport on one side of the machine in the manner as shown in FIG. 1. In use, the conveyor 16 may be swiveled around to a position in which grain may be dumped into a lower inlet end portion 17 and discharged from an upper outlet end 18 into an inlet chute 19 of the screener 10.

The grain to be cleaned is fed through the inlet chute 19 into an inner drum 20 which includes an annular coarse mesh screen 22 supported between a pair of axially spaced annular rim portions 23 and 24. Coarse materials, such as pieces of stover, are retained by the screen 22. Grain and fine materials fall through the coarse mesh screen 22 into an outer drum 26 which includes a rim 27 at the forward end of the screener and a rim 28 at the rear end thereof. The outer drum 26 further includes a fine mesh screen which is preferably in two sections 29 and 30, section 29 being disposed between the rim 27 and an intermediate rim 31 and section 30 being disposed between the intermediate rim 31 and the rear rim 28. The fine mesh screen is of a mesh size such as to pass the fine foreign materials and to retain the whole grain.

The grain collected in the outer drum 26 may preferably be removed therefrom at an outlet formed adjacent the lower end of the rim 28 at the rear end of the screener. The fine foreign materials which pass through the fine mesh screen sections 29 and 30 are collected in a pan 32 and are moved axially by an auger 33 to the front end of the pan, to be removed therefrom by a built-in auger 35 which conveys the materials upwardly through a conduit 36 to a discharge end 37 on one side of the screener 10.

The inner drum 20 preferably has a frusto-conical shape as illustrated, such as to aid in insuring that the grain will pass through the coarse mesh screen 22 before reaching the rearward smaller diameter end thereof from which the coarse materials are removed. To remove the coarse materials, a generally cup-shaped housing part 38 is supported from a central shaft of the screener, on a hub 47 in surrounding relation to the smaller diameter outlet end of the inner drum 20 and it is connected through a conduit 39 to another cup-shaped housing part 40, also supported from the central shaft of the screener. In the illustrated construction, the housing part 38, conduit 39 and housing part 40 rotate with the outer drum 26. A stationary rear wall 41 is positioned in proximity to the rearward open end of the cup-shaped housing part 40 and is formed with a forwardly extending semi-cylindrical shroud portion 41A which underlies the part 40. Such components cooperate to define a manifold for collection of the coarse foreign materials which are sometimes referred to as "trash". The stationary rear wall 41 is formed with an opening 41B opposite the lower part of the outer drum to provide an exit opening for clean grain.

Figure 2:
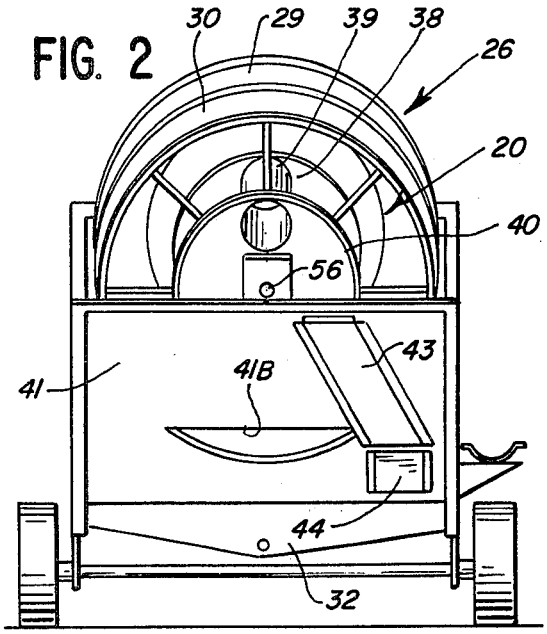
FIG. 2 is a rear elevational view of the screener with the feed-in conveyor removed therefrom.
Figure 4:
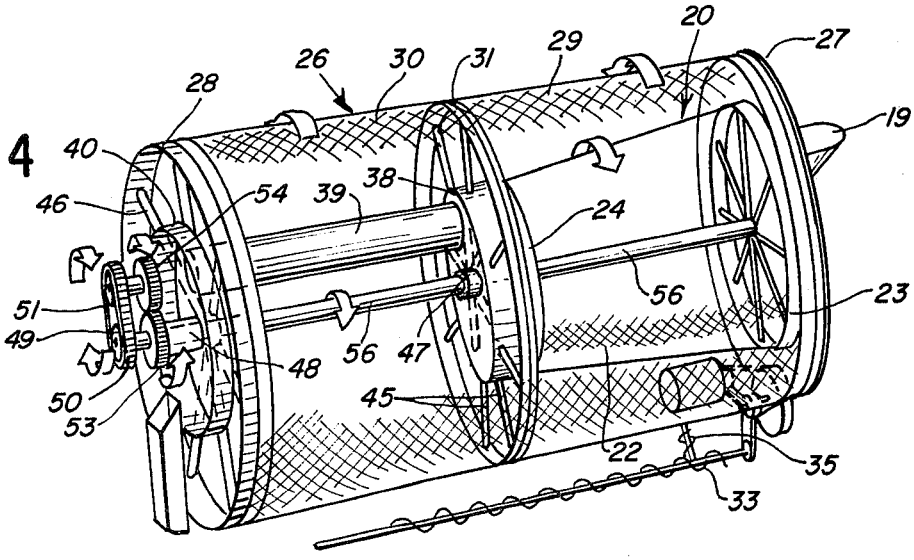
FIG. 4 is a perspective view showing diagrammatically the reverse drive transmission assembly and other features of the invention, also showing the directions of rotation of various parts, the size of components of the reverse drive transmission being illustrated as being disproportionately large in relation to other parts, to clarify the operation thereof.

In operation, the coarse foreign materials may move by gravity into the forward end of the conduit 39 when it is in its lowermost position, and subsequently will be discharged from the rearward end thereof into the manifold formed by the part 40 and the cooperating portions of the rear screener wall 41. With reference to FIGS. 2, 4 and 8, the coarse foreign materials collecting in the manifold formed by part 40 and the cooperating portion of the rear wall 41 may be discharged through an opening 42 in the rear wall 41 and through a stationary chute 43 and into another chute 44 to be discharged into the rear end of the pan 32. The chutes 43 and 44 are disposed rearwardly of the outer drum 26. It is noted that the coarse materials may be selectively collected separate from the fine foreign materials, by removing the chute 44 and positioning a collecting container below the lower end of the chute 43, or by simply allowing the coarse foreign materials to collect on the ground.

In the illustrated arrangement, the cup-shaped parts 38 and 40 and the conduit 39 are rotated with the outer drum, being connected to spokes 45 and spokes 46 which extend radially from part 38 and bushing or hub 48 to the rims 31 and 28 of the outer drum 26. Alternatively, the components 38, 39 and 40 may be connected to the inner drum for rotation therewith.

Important features of the invention relate to the drive of the drums 20 and 26 and the augers 33 and 35. In accordance with the invention, a reverse drive transmission assembly is provided in which a reverse drive is obtained between first and second drive members which are respectively connected to the two drums and which are journalled for rotation on the common axis of the two drums. The first drive member in the illustrated construction is a sprocket 49 which is drivingly connected through a chain 50 to a second sprocket 51 secured to a shaft 52 on an axis parallel to the axis of rotation of the first sprocket 49. The second drive member in the illustrated construction is a gear 53 which is fixedly connected to the bushing 48 and thereby to the outer drum 26. Gear 53 is meshed with a gear 54 secured to the shaft 52 and sprocket 51 for rotation therewith. The sprocket 49 is fixedly secured to a central shaft 56 of the screener which is secured to the inner drum 20. The rearward end of the shaft 56 is journalled in a bearing 57 which is supported on a cross frame member 58. The frame member 58 also supports housing structure 59 of the drive transmission assembly, including wall portions 60 and 61 from which the shaft 52 is journalled.

Gear 53 is fixedly connected to the bushing 48 which forms a hub for the outer drum 26 at the rear end of the screeners, bushing 48 being connected to the rear rim 28 of the outer drum through the spokes 46. The shaft 56 is rotatable relative to the gear 53 and bushing 48 and extends therethrough to a forward end at which it is secured to the inner drum 20.

The reverse drive transmission assembly operates to drive one drum in one direction when the other drum is driven from a motive power source in the reverse direction. In the illustrated screener, the outer drum 26 is driven through a drive transmission assembly at the forward end of the screener and drive torque is transmitted to the gear 53 through the spokes 46 and bushing 48. Gear 53 drives the gear 54 in the reverse direction, the gear 54 being coupled through the sprocket 51, chain 50 and sprocket 49 to the shaft 56 which is driven in the same direction as the gear 54 and in a direction opposite the direction of the outer drum. Shaft 56 is coupled directly to the inner drum 20 to thus drive the inner drum in a direction opposite the direction of rotation of the outer drum 26.

The reverse drive transmission assembly is of quite compact form and in the illustrated arrangement, it is positioned within the manifold formed by the part 40 and the cooperating portions of the rear wall 41, taking up very little space in the manifold. It is noted that the size of the gear, sprocket and chain components are disproportionately large in the illustration of FIG. 4 which is provided for explanation of the operation.

Additional features of the drive arrangement relate to the drive of one of the drums, the outer drum 26 being preferably driven. With reference to FIGS. 3-6, the outer drum 26 is driven by a drive mechanism generally designated by reference numeral 64 and including a belt 65 which is entrained about the outside of the front rim 27 of the outer drum 26, it being noted that no separate pulley is thus required with the rim 27 being operative to perform two functions. The belt 65 is driven by a pulley 66 which is secured to a shaft 67 supported and journalled by a bearing 68 on a cross frame member 69. Another pulley 70 is secured to the shaft 67 and is driven by a belt 71 from a pulley 72 on a shaft 73 of an electric motor 74 mounted on the frame member 69. A take-up roller 75 engages the slack side of the belt 65 and is carried at one end of a lever 76 which is pivotally mounted on the frame member 69 with a tension spring 77 being connected to the opposite end of the lever 76 to urge the take-up roller 75 into engagement with the belt 65.

A central shaft portion 79 of the auger 33 has secured thereto at one end a pulley 80 which is coupled through a belt 81 to a pulley 82 which is secured to the inner end of the shaft 67, the auger 33 being thereby driven from the shaft 67 which is driven from the motor 74.

To drive the vertical auger 35, a central shaft portion 83 thereof has secured thereto at its lower end a pulley 84 which is coupled through a belt 85 to a pulley 86 which is secured to one end of a shaft 87. An idler pulley 88 engages the belt 85 and is so positioned and journalled as to properly align the belt 85 with the pulleys 84 and 86 and to obtain the proper direction of rotation of the auger 35, it being noted that the axis of shafts 83 and 87 are at right angles to each other and do not intersect. At its outer end, shaft 87 carries a pulley 89 which is coupled through a belt 90 to a pulley 91 on the end of the shaft portion 79 of auger 33.

With the arrangement as shown, the drive components are all relatively close together so that the belts can have short lengths and they are all located on the underside of the outer drum which is advantageous in that the entire front face of the drum assembly is clear of the drive components. It is noted that protective housing structure is disposed in front of the drive components, the screener being illustrated with such structure removed.

Figure 3:
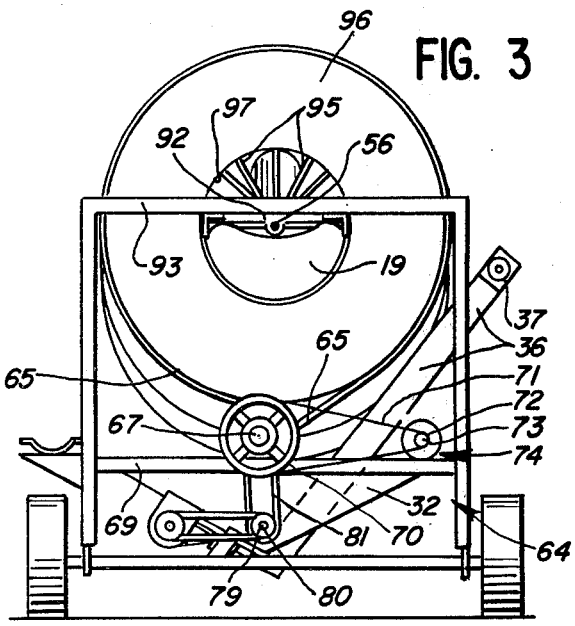
FIG. 3 is a front elevational view of the screener, with the feed-in conveyor removed and also with protective housing structure removed, to show drive components.

As shown in FIGS. 3 and 8, the front end of the central support shaft 56 is journalled in a bearing 92 which is carried on the underside of a cross frame member 93. A bushing 94 is rotatably disposed on the shaft 56 adjacent the bearing 92 and is connected through spokes 95 to the forward rim portion 27 of the outer drum 26. The outer drum 26 at its forward end may preferably have an end wall portion 96, a central opening 97 being provided in the wall 96 through which the grain to be cleaned is supplied. The forward and rearward rim portions 23 and 24 of the inner drum 20 are connected to the central shaft 56 through spokes 99 and 100, for rotation therewith.

The rim 24 may extend within the cup-shaped part 38, as shown in FIG. 8.

FIG.9 shows schematically the presently preferred screener utilizing this invention. In this screener, inner and outer drums 20' and 26' are supported from a central shaft 56', corresponding parts being indicated by primed numbers. In the screener of FIG. 9, a screen section 106 is provided which operates as a rearward extension of the inner drum but which is rotatable with the outer drum in the modification as shown. The screen section 106 includes a screen 107 which preferably has a coarse mesh like that of the drum 20', the screen 107 being carried between a pair of rims 109 and 110 which are respectively carried from the spokes 45' and 46' of the outer drum 26'. The screen section 106 operates to perform a cleaning function in that grain which is received in the screen section 106 may pass through the screen 107 into the outer drum 26'. It also operates to convey coarse foreign materials to a manifold which is formed by the rim 110 and cooperating portions of the end wall 41' of the screener.

As shown in FIG. 9, a baffle plate 111 is carried by a bushing 112 which is secured to the shaft 56' within the inner drum 20'. The baffle plate 111 may be used to control the rate of flow of the coarse foreign materials and its position may be adjusted along the shaft 56'. A similar baffle plate is preferably provided in the first-described embodiment.

FIG. 10 shows another screener which is similar to the screener of FIG. 9 and which includes an outer drum 26'' similar to the drums 26 and 26', corresponding parts being indicated by double-primed numerals.

In the screener of FIG. 10, a screen section 114 is provided which is similar to the screen section 106 of FIG. 9 but is rotatable with the inner drum 20''. The arrangement includes a rim 115 which forms both the rearward rim of the frusto-conical section of the inner drum 20' and the forward rim of the screen section 114, the rim 115 being secured to a central shaft 56'' through spokes 116. At its rearward end, the screen section 114 includes a rim 117 which is supported from the shaft 56'' through spokes 118.

As also illustrated in FIG. 10, the outer drum 26'' may include an intermediate rim 120 supported through spokes 121 from a hub in the form of a ring 122 which is journalled on the outside of the rim 115 through a suitable bearing 123. It will be appreciated that if desired, the outer drum may be so constructed as not to require bearing support of an intermediate rim thereof.

The arrangement of FIG. 10 operates in the same manner as the arrangement of FIG. 9, except that the screen section 114 rotates with the frusto-conical inner drum screen section, rather than in an opposite direction as is the case with respect to the screen section 106 in the FIG. 9.

It will be understood that modifications and variations may be effected without departing from the spirit and scope of the novel concepts of this invention.

We claim:

1. In a rotary grain screener which includes an inner drum including an annular coarse mesh screen and a plurality of axially spaced rim means supporting said coarse mesh screen, an outer drum including an annular fine mesh screen and a plurality of axially spaced rim means supporting said fine mesh screen, frame means supporting and journalling said drums for rotation about a common axis, and drive means for rotating said drums in opposite directions, said drive means comprising: a reverse drive transmission assembly including first and second members at one end of said outer drum and journalled for rotation about said common axis, a drive transmission between said first and second members at said one end for effecting rotation of one of said members in a direction opposite that of the other, a first component connected to said first member and disposed along said common axis, a second component connected to said second member and disposed along said common axis, first connecting means coupled to said first component and extending radially outwardly to one of said rim means of said inner drum, second connecting means coupled to said second component and extending radially outwardly to one of said rim means of said outer drum, a motive power source, and a second drive transmission assembly positioned and arranged for driving one of said drums from said motive power source to effect rotation thereof in one direction and rotation of the other of said drums in a reverse direction through said reverse drive transmission assembly.

2. In a screener as defined in claim 1, said first component comprising a shaft rotatable on said common axis and secured through said first connecting means to said one of said rim means of said inner drum, and said second component comprising a bushing rotatably journalled on said shaft and secured through said second connecting means to said outer drum, said first member being secured to said shaft, and said second member being secured to said bushing.

3. In a screener as defined in claim 1, said second drive transmission assembly being located adjacent one end of said outer drum, and said reverse drive transmission assembly being located adjacent the opposite end of said outer drum.

4. In a screener as defined in claim 3, further including means for supplying grain to be cleaned through said one end of said outer drum and into one end of said inner drum.

5. In a screener as defined in claim 4, said one of said rim means of said outer drum being at said opposite end thereof, and said outer drum including an additional rim means at said one end thereof, and said second drive transmission assembly comprising a belt entrained about the outside of said additional one of said rim means of said outer drum at said one end thereof.

6. In a screener as defined in claim 4, further including coarse foreign material manifold means located adjacent said reverse drive transmission assembly and adjacent said opposite end of said outer drum.

7. In a screener as defined in claim 6, further including foreign material discharge means for conveying coarse foreign material away from said coarse foreign material manifold means.

8. In a screener as defined in claim 7, further including a pan underlying said outer drum to directly receive fine foreign material therefrom and arranged for receiving coarse foreign material from said coarse foreign material discharge means.

9. In a screener as defined in claim 8, further including a conveyor having an inlet in said pan and extending upwardly to an elevated outlet for discharge of fine foreign material and any coarse foreign material collected in said pan.

10. In a screener as defined in claim 9, further including an auger in said pan for conveying material in said pan toward said inlet of said conveyor.

11. In a screener as defined in claim 10, said conveyor and said auger having input drive connections in proximity to said second drive transmission assembly, and drive coupling means between said second drive transmission assembly and said drive inputs of said auger and said conveyor.

12. In a screener as defined in claim 1, one of said first and second members being in the form of a sprocket and the other of said first and second members being in the form of a gear, a second sprocket and a second gear journalled for rotation together on an axis parallel to said common axis with said second gear being meshed with the first gear, and a chain entrained about said sprockets to provide a drive connection therebetween.

13. In a screener as defined in claim 1, including foreign material receiving and transport means for collection and removal of foreign material from said screener, said foreign material receiving and transport means comprising: a pan underlying said outer drum to directly receive fine foreign material therefrom, a conveyor having an inlet in said pan and extending upwardly to an elevated outlet for discharge of foreign material from said pan, and a drive connection between said second drive transmission assembly and said conveyor.

14. In a screener as defined in claim 13, further including an auger in said pan for conveying material in said pan to said inlet of said conveyor, said auger and said conveyor having input drive connections at one end of said screener in proximity to said second drive transmission assembly, said drive connection being arranged to drive both said conveyor and said auger.

* * * * *

UNITED STATES PATENT AND TRADEMARK OFFICE

CERTIFICATE OF CORRECTION

PATENT NO. : 4,440,637

DATED : April 3, 1984

INVENTOR(S) : Edward H. Smit and Eugene G. Sukup

It is certified that error appears in the above-identified patent and that said Letters Patent is hereby corrected as shown below:

On the title page:
Under References Cited for
U.S. Patent Documents add "4,274,750 6/1981 Smit....366/261"

Signed and Sealed this

*Fourth* Day of *September 1984*

[SEAL]

*Attest:*

GERALD J. MOSSINGHOFF

*Attesting Officer*

*Commissioner of Patents and Trademarks*